US009803628B2

(12) United States Patent
Ota et al.

(10) Patent No.: US 9,803,628 B2
(45) Date of Patent: Oct. 31, 2017

(54) COMPRESSOR WITH DRIVE AND TILT MECHANISMS LOCATED ON THE SAME SIDE OF A SWASH PLATE

(71) Applicant: KABUSHIKI KAISHA TOYOTA JIDOSHOKKI, Kariya-shi, Aichi-ken (JP)

(72) Inventors: Masaki Ota, Kariya (JP); Takahiro Suzuki, Kariya (JP); Kazunari Honda, Kariya (JP); Kei Nishii, Kariya (JP); Yusuke Yamazaki, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 571 days.

(21) Appl. No.: 14/227,055

(22) Filed: Mar. 27, 2014

(65) Prior Publication Data

US 2014/0294614 A1 Oct. 2, 2014

(30) Foreign Application Priority Data

Mar. 29, 2013 (JP) ..... 2013-073819

(51) Int. Cl.
*F04B 27/18* (2006.01)
*F04B 27/10* (2006.01)
*F04B 1/14* (2006.01)

(52) U.S. Cl.
CPC ..... *F04B 27/18* (2013.01); *F04B 1/146* (2013.01); *F04B 27/1054* (2013.01);
(Continued)

(58) Field of Classification Search
CPC ..... F04B 27/1804; F04B 27/1063; F04B 27/1054; F04B 27/1072; F04B 27/1036;
(Continued)

(56) References Cited

U.S. PATENT DOCUMENTS 3,062,020 A * 11/1962 Heidorn ..... F04B 27/109 184/6.17
3,575,534 A * 4/1971 Leduc ..... F04B 1/14 417/218

(Continued)

FOREIGN PATENT DOCUMENTS

JP 58-162780 A 9/1983
JP 62-225782 A 10/1987

(Continued)

OTHER PUBLICATIONS

Communication dated Nov. 4, 2015 from the State Intellectual Property Office of the P.R.C. in counterpart application No. 201410116616.5.

(Continued)

*Primary Examiner* — Bryan Lettman
*Assistant Examiner* — Timothy Solak
(74) *Attorney, Agent, or Firm* — Sughrue Mion, PLLC

(57) ABSTRACT

A double-headed piston swash plate type compressor includes a rotary shaft, a drive force transmitting member, a tiltable swash plate, a movable body that changes the inclination angle of the swash plate, and a control pressure chamber defined by the movable body and the drive force transmitting member, which are arranged on one side with respect to the swash plate in the axial direction of the rotary shaft. The movable body includes a bottom portion, through which the rotary shaft extends, and a cylindrical portion, which extends from the bottom portion in the axial direction of the rotary shaft to surround the rotary shaft. The cylindrical portion is permitted to move in the axial direction while sliding along a part of the drive force transmitting member, so that the inclination angle of the swash plate is changed in accordance with the internal pressure of the control pressure chamber.

8 Claims, 8 Drawing Sheets

(52) U.S. Cl.
CPC ..... *F04B 27/1063* (2013.01); *F04B 27/1072* (2013.01); *F04B 27/1081* (2013.01); *F04B 27/1804* (2013.01); *F04B 2027/1813* (2013.01); *F04B 2027/1886* (2013.01)

(58) Field of Classification Search
CPC ..... F04B 2027/1886; F04B 2027/1813; F04B 2027/1809; F04B 2027/1818; F04B 2027/1018; F04B 2027/1822; F04B 1/29; F04B 1/28; F04B 1/16; F04B 1/14; F04B 1/146; F04B 1/141; F04B 1/295; F04B 27/10; F04B 27/16; F04B 27/18; F04B 27/1081
See application file for complete search history.

(56) References Cited

U.S. PATENT DOCUMENTS

| | | | | |
|---|---|---|---|---|
| 4,037,993 | A | 7/1977 | Roberts | |
| 4,149,830 | A * | 4/1979 | Woodruff | F04B 1/18 417/222.1 |
| 4,836,090 | A | 6/1989 | Smith | |
| 4,886,423 | A * | 12/1989 | Iwanami | F04B 27/18 417/222.2 |
| 4,963,074 | A | 10/1990 | Sanuki et al. | |
| 5,002,466 | A | 3/1991 | Inagaki et al. | |
| 5,032,060 | A | 7/1991 | Kobayashi et al. | |
| 5,259,736 | A | 11/1993 | Terauchi | |
| 5,370,503 | A * | 12/1994 | Terauchi | F04B 27/1072 417/222.2 |
| 5,380,166 | A | 1/1995 | Terauchi | |
| 6,024,008 | A | 2/2000 | Kawaguchi et al. | |
| 6,742,439 | B2 | 6/2004 | Matsuda et al. | |
| 6,957,604 | B1 * | 10/2005 | Tiedemann | F04B 1/295 417/222.1 |
| 9,309,875 | B2 | 4/2016 | Yamamoto et al. | |
| 9,316,217 | B2 | 4/2016 | Yamamoto et al. | |
| 2003/0223887 | A1 | 12/2003 | Kawano et al. | |
| 2012/0073430 | A1 | 3/2012 | Uchikado | |
| 2014/0127044 | A1 | 5/2014 | Yamamoto et al. | |
| 2015/0252798 | A1 | 9/2015 | Suzuki et al. | |

FOREIGN PATENT DOCUMENTS

| | | | |
|---|---|---|---|
| JP | 64-041680 | A | 2/1989 |
| JP | 01-147171 | A | 6/1989 |
| JP | 02-016374 | A | 1/1990 |
| JP | 02-019665 | A | 1/1990 |
| JP | 3-10082 | U | 1/1991 |
| JP | 04-054287 | A | 2/1992 |
| JP | 4-191472 | A | 7/1992 |
| JP | 05-018355 | A | 1/1993 |
| JP | 05-172052 | A | 7/1993 |
| JP | 10-205440 | A | 8/1998 |
| JP | 2004-52623 | A | 2/2004 |
| JP | 2007-239722 | A | 9/2007 |
| JP | 2014-92104 | A | 5/2014 |

OTHER PUBLICATIONS

Communication dated Oct. 15, 2014 from the European Patent Office in counterpart application No. 14161646.6.
Communication dated May 4, 2017 from the United States Patent and Trademark Office in counterpart U.S. Appl. No. 14/778,792.
Communication dated Aug. 16, 2017 from the German Patent Office in counterpart Application No. 11 2014 001 751.5.

* cited by examiner

COMPRESSOR WITH DRIVE AND TILT MECHANISMS LOCATED ON THE SAME SIDE OF A SWASH PLATE

BACKGROUND OF THE INVENTION

The present invention relates to a double-headed piston swash plate type compressor, in which double-headed piston engaged with a swash plate are reciprocated by a stroke corresponding to the inclination angle of a swash plate.

Such a double-headed piston swash plate type compressor (hereinafter, simply referred to as "compressor") is disclosed in Japanese Laid-Open Patent Publication No. 5-172052. As shown in FIGS. 7 and 8, the compressor 100 disclosed in the above publication includes a housing 101, which is formed by a cylinder block 102, a front housing member 104, and a rear housing member 105. The front housing member 104 closes the front end of the cylinder block 102 via a valve plate 103*a*, and the rear housing member 105 closes the rear end of the cylinder block 102 via a valve plate 103*b*.

A through hole 102*h* is formed at the center of the cylinder block 102. The through hole 102*h* receives a rotary shaft 106, which extends through the front housing member 104. The cylinder block 102 has cylinder bores 107 formed about the rotary shaft 106. Each cylinder bore 107 houses a double-headed piston 108. The cylinder block 102 further has a crank chamber 102*a*. The crank chamber 102*a* accommodates a tiltable swash plate 109, which rotates when receiving drive force from the rotary shaft 106. Each double-headed piston 108 is engaged with the swash plate 109 via shoes 110. The front housing member 104 and the rear housing member 105 have suction chambers 104*a*, 105*a* and discharge chambers 104*b*, 105*b*, which communicate with the cylinder bores 107.

An actuator 111 is arranged at the rear end of the through hole 102*h* of the cylinder block 102. The actuator 111 accommodates in it the rear end of the rotary shaft 106. The interior of the actuator 111 is slidable along the rear end of the rotary shaft 106. The periphery of the actuator 111 is slidable along the through hole 102*h*. A pressing spring 112 is located between the actuator 111 and the valve plate 103*b*. The pressing spring 112 urges the actuator 111 toward the front end of the rotary shaft 106. The urging force of the pressing spring 112 is determined by the balance with the pressure in the crank chamber 102*a*.

A part of the through hole 102*h* that is rearward of the actuator 111 communicates with a pressure regulating chamber 117 (control pressure chamber), which is formed in the rear housing member 105, via a through hole. The pressure regulating chamber 117 is connected to the discharge chamber 105*b* via a pressure regulating circuit 118. A pressure control valve 119 is arranged in the pressure regulating circuit 118. The amount of movement of the actuator 111 is adjusted by the pressure in the pressure regulating chamber 117.

A first coupling body 114 is arranged in front of the actuator 111 with a thrust bearing 113 in between. The rotary shaft 106 extends through the first coupling body 114. The interior of the first coupling body 114 is slidable along the rotary shaft 106. The first coupling body 114 is designed to slide along the axis of the rotary shaft 106 when the actuator 111 slides. The first coupling body 114 has a first arm 114*a*, which extends outward from the periphery. The first arm 114*a* has a first pin guiding groove 114*h*, which is formed by cutting out a part diagonally with respect to the axis of the rotary shaft 106.

A second coupling body 115 (drive force transmitting member) is arranged in front of the swash plate 109. The second coupling body 115 is fixed to the rotary shaft 106 to rotate integrally with the rotary shaft 106. The second coupling body 115 has a second arm 115*a*, which extends outward from the periphery and is located at a symmetrical position with respect to the first arm 114*a*. The second arm 115*a* has a second pin guiding groove 115*h*, which extends through the second arm 115*a* in a diagonal direction with respect to the axis of the rotary shaft 106.

Two first supporting lobes 109*a*, which extend toward the first arm 114*a*, are formed on a surface of the swash plate 109 that faces the first coupling body 114. The first arm 114*a* is located between the two first supporting lobes 109*a*. The two first supporting lobes 109*a* and the first arm 114*a* are pivotally coupled to each other by a first coupling pin 114*p*, which extends through first pin guiding groove 114*h*.

Two second supporting lobes 109*b*, which extend toward the second arm 115*a*, are formed on a surface of the swash plate 109 that faces the second coupling body 115. The second arm 115*a* is located between the second supporting lobes 109*b*. The two second supporting lobes 109*b* and the second arm 115*a* are pivotally coupled to each other by a second coupling pin 115*p*, which extends through second pin guiding groove 115*h*. The swash plate 109 receives drive force from the rotary shaft 106 via the second coupling body 115 to be rotated.

To decrease the displacement of the compressor 100, the pressure in the pressure regulating chamber 117 is lowered by closing the pressure control valve 119. This causes the pressure in the crank chamber 102*a* to be greater than the pressure in the pressure regulating chamber 117 and the urging force of the pressing spring 112. Accordingly, the actuator 111 is moved toward the valve plate 103*b* as shown in FIG. 7. At this time, the first coupling body 114 is pushed toward the actuator 111 by the pressure in the crank chamber 102*a*. The movement of the first coupling body 114 causes the first coupling pin 114*p* to be guided by the first pin guiding groove 114*h*, so that first supporting lobes 109*a* rotate counterclockwise. As the first supporting lobes 109*a* rotate, the second supporting lobes 109*b* rotate counterclockwise, so that the second coupling pin 115*p* is guided by the second pin guiding groove 115*h*. This reduces the inclination angle of the swash plate 109 and thus reduces the stroke of the double-headed pistons 108. Accordingly, the displacement is decreased.

In contrast, to increase the displacement of the compressor 100, the pressure control valve 119 is opened to introduce high-pressure gas (control gas) from the discharge chamber 105*b* to the pressure regulating chamber 117 via the pressure regulating circuit 118, thereby increasing the pressure in the pressure regulating chamber 117. This causes the pressure in the pressure regulating chamber 117 and the urging force of the pressing spring 112 to be greater than the pressure in the crank chamber 102*a*. Accordingly, the actuator 111 is moved toward the swash plate 109 as shown in FIG. 8.

At this time, the first coupling body 114 is pushed by the actuator 111 and moved toward the second coupling body 115. The movement of the first coupling body 114 causes the first coupling pin 114*p* to be guided by the first pin guiding groove 114*h*, so that first supporting lobes 109*a* rotate clockwise. As the first supporting lobes 109*a* rotate, the second supporting lobes 109*b* rotate clockwise, so that the second coupling pin 115*p* is guided by the second pin guiding groove 115*h*. This increases the inclination angle of the swash plate 109 and thus increases the stroke of the double-headed pistons 108. Accordingly, the displacement is increased.

In the structure of the compressor 100 of the above publication, each cylinder bore 107 houses a double-headed piston 108, and the double-headed pistons 108 linearly reciprocate in a region radially outward of the rotary shaft 106 in the cylinder block 102. Thus, in the cylinder block 102, the space for accommodating the second coupling body 115, the actuator 111, and the first coupling body 114 is limited to be inward in the radial direction of the rotary shaft 106 in relation to the region in which the double-headed pistons 108 perform linear reciprocation.

The second coupling body 115 is aligned with the actuator 111 and the first coupling body 114 along the axis of the rotary shaft 106 with the swash plate 109 in between. Therefore, the pressure regulating chamber 117, into which high-pressure gas is introduced to control the movement of the actuator 111 and the first coupling body 114, needs to be formed on the opposite side of the swash plate 109 from the second coupling body 115 in the axial direction of the rotary shaft 106. As a result, the second coupling body 115 is arranged on one side of the swash plate 109 in the axial direction of the rotary shaft 106. Further, the actuator 111, the first coupling body 114, and the pressure regulating chamber 117 are located on the other side of the swash plate 109 in the axial direction of the rotary shaft 106. This increases the size of the compressor 100 in the axial direction of the rotary shaft 106.

SUMMARY OF THE INVENTION

Accordingly, it is an objective of the present invention to provide a double-headed piston swash plate type compressor that is capable of reducing its size in the axial direction of the rotary shaft.

To achieve the foregoing objective and in accordance with one aspect of the present invention, a double-headed piston swash plate type compressor is provided that includes a pair of cylinder blocks, a first cylinder bore, a second cylinder bore, a double-headed piston, a rotary shaft, a drive force transmitting member, a swash plate, a movable body, and a control pressure chamber. The cylinder blocks form a housing and have a crank chamber. The first cylinder bore and the second cylinder bore are respectively formed in the two cylinder blocks to form a pair. The double-headed piston is reciprocally received in the first and second cylinder bores. The rotary shaft is rotationally supported by the housing. The drive force transmitting member is accommodated in the crank chamber and fixed to the rotary shaft to rotate integrally with the rotary shaft. The swash plate is accommodated in the crank chamber and rotated by a drive force of the rotary shaft via the drive force transmitting member. An inclination angle of the swash plate relative to the rotary shaft is changeable. The drive force transmitting member has a link portion that guides the swash plate to change the inclination angle. The double-headed piston is engaged with the swash plate and is reciprocated by a stroke that corresponds to the inclination angle of the swash plate. The movable body is coupled to the swash plate and capable of changing the inclination angle of the swash plate. The control pressure chamber is defined by the movable body and the drive force transmitting member. The drive force transmitting member and the movable body are arranged on one side of the swash plate in an axial direction of the rotary shaft. Control gas is introduced into the control pressure chamber to change an internal pressure of the control pressure chamber, so that the movable body is moved in the axial direction of the rotary shaft. The movable body includes a bottom portion, through which the rotary shaft extends, and a cylindrical portion, which extends from the bottom portion in the axial direction of the rotary shaft to surround the rotary shaft. The cylindrical portion is permitted to move in the axial direction of the rotary shaft while sliding along a part of the drive force transmitting member, so that the inclination angle of the swash plate is changed in accordance with changes in the internal pressure of the control pressure chamber.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment will now be described with reference to FIGS. 1 to 4. A double-headed piston swash plate type compressor 10 (hereinafter, simply referred to as "compressor") is mounted in a vehicle.

Figure 1:
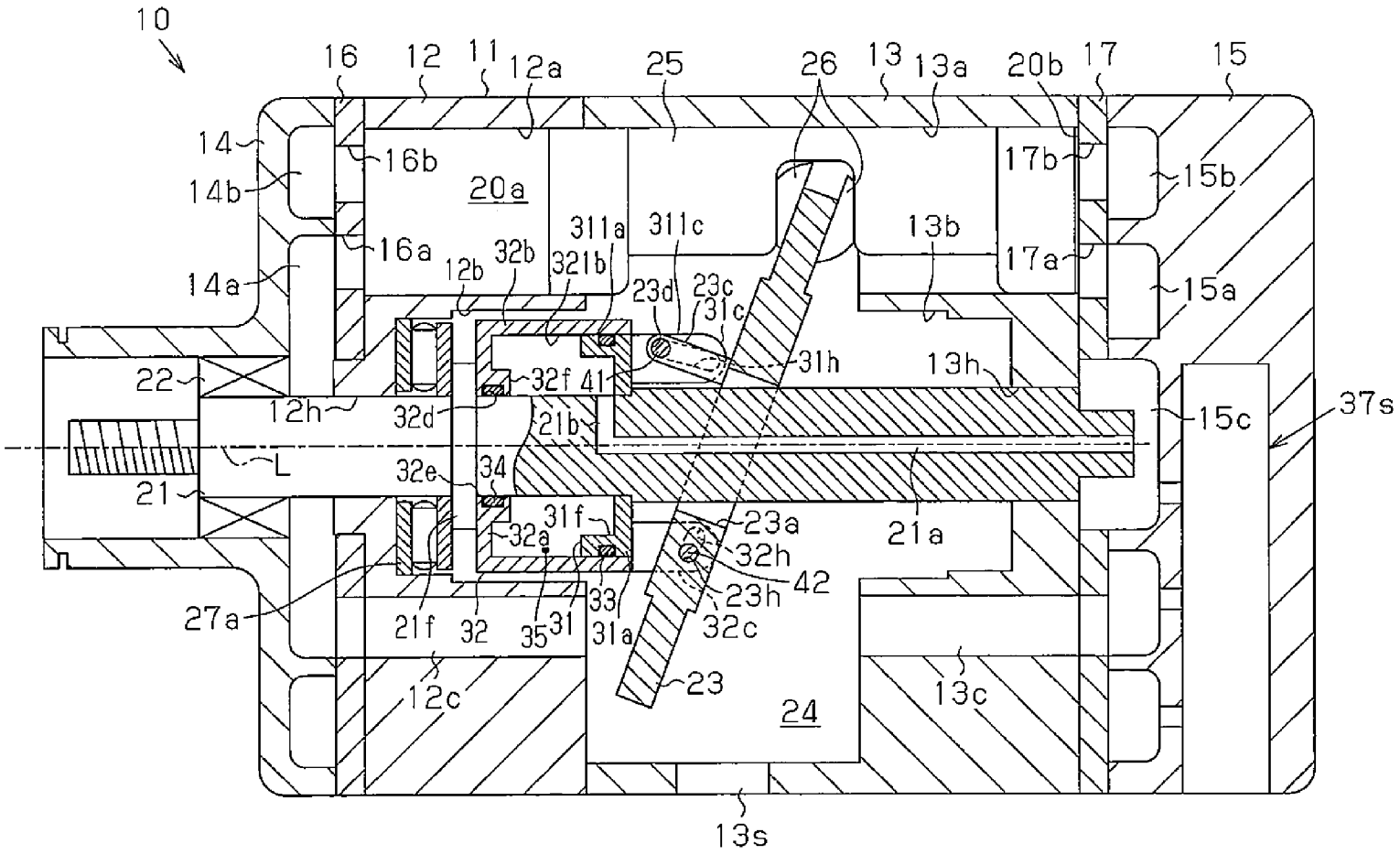
FIG. 1 is a cross-sectional side view illustrating a double-headed piston swash plate type compressor according to one embodiment.

As shown in FIG. 1, the compressor 10 includes a housing 11, which is formed by a first cylinder block 12 located on the front side (first side) and a second cylinder block 13 located on the rear side (second side). The first and second cylinder blocks 12, 13 are joined to each other. The housing 11 further includes a front housing member 14 joined to the first cylinder block 12 and a rear housing member 15 joined to the second cylinder block 13. The first cylinder block 12 and the second cylinder block 13 are cylinder blocks that are part of the housing 11. The first cylinder block 12 and the second cylinder block 13 form a pair.

A first valve plate 16 is arranged between the front housing member 14 and the first cylinder block 12. Further, a second valve plate 17 is arranged between the rear housing member 15 and the second cylinder block 13.

A suction chamber 14*a* and a discharge chamber 14*b* are defined between the front housing member 14 and the first valve plate 16. The discharge chamber 14*b* is located radially outward of the suction chamber 14*a*. Likewise, a suction chamber 15*a* and a discharge chamber 15*b* are defined between the rear housing member 15 and the second valve plate 17. Additionally, a pressure adjusting chamber 15*c* is formed in the rear housing member 15. The pressure adjusting chamber 15*c* is located at the center of the rear housing member 15, and the suction chamber 15*a* is located radially outward of the pressure adjusting chamber 15*c*. The discharge chamber 15*b* is located radially outward of the suction chamber 15*a*. The discharge chamber 14*b*, 15*b* are connected to each other through a discharge passage (not shown). The discharge passage is in turn connected to an external refrigerant circuit (not shown).

The first valve plate 16 has suction ports 16*a* connected to the suction chamber 14*a* and discharge ports 16*b* connected to the discharge chamber 14*b*. The second valve plate 17 has suction ports 17*a* connected to the suction chamber 15*a* and discharge ports 17*b* connected to the discharge chamber 15*b*. A suction valve mechanism (not shown) is arranged in each of the suction ports 16*a*, 17*a*. A discharge valve mechanism (not shown) is arranged in each of the discharge ports 16*b*, 17*b*.

A rotary shaft 21 is rotationally supported in the housing member 11. A part of the rotary shaft 21 on the front side (first side) extends through a shaft hole 12*h*, which is formed to extend through the first cylinder block 12. Specifically, the front part of the rotary shaft 21 refers to a part of the rotary shaft 21 that is located on the first side in the direction along the axis L of the rotary shaft 21 (the axial direction of the rotary shaft 21). The front end of the rotary shaft 21 is located in the front housing member 14. A part of the rotary shaft 21 on the rear side (second side) extends through a shaft hole 13*h*, which is formed in the second cylinder block 13. Specifically, the rear part of the rotary shaft 21 refers to a part of the rotary shaft 21 that is located on the second side in the direction in which the axis L of the rotary shaft 21 extends. The rear end of the rotary shaft 21 is located in the pressure adjusting chamber 15*c*.

The front part of the rotary shaft 21 is rotationally supported by the first cylinder block 12 at the shaft hole 12*h*. The rear part of the rotary shaft 21 is rotationally supported by the second cylinder block 13 at the shaft hole 13*h*. A sealing device 22 of lip seal type is located between the front housing member 14 and the rotary shaft 21.

In the housing 11, the first cylinder block 12 and the second cylinder block 13 define a crank chamber 24. A swash plate 23 is accommodated in the crank chamber 24. The swash plate 23 receives drive force from the rotary shaft 21 to be rotated. The swash plate 23 is also tiltable along the axis L of the rotary shaft 21 with respect to the rotary shaft 21. The swash plate 23 has an insertion hole 23*a*, through which the rotary shaft 21 can extends. The swash plate 23 is assembled to the rotary shaft 21 by inserting the rotary shaft 21 into the insertion hole 23*a*.

The first cylinder block 12 has first cylinder bores 12*a* (only one of the first cylinder bores 12*a* is illustrated in FIG. 1), which extend along the axis of the first cylinder block 12 and are arranged about the rotary shaft 21. Each first cylinder bore 12*a* is connected to the suction chamber 14*a* via the corresponding suction port 16*a* and is connected to the discharge chamber 14*b* via the corresponding discharge port 16*b*. The second cylinder block 13 has second cylinder bores 13*a* (only one of the second cylinder bores 13*a* is illustrated in FIG. 1), which extend along the axis of the second cylinder block 13 and are arranged about the rotary shaft 21. Each second cylinder bore 13*a* is connected to the suction chamber 15*a* via the corresponding suction port 17*a* and is connected to the discharge chamber 15*b* via the corresponding discharge port 17*b*. The first cylinder bores 12*a* and the second cylinder bores 13*a* are arranged to make front-rear pairs. Each pair of the first cylinder bore 12*a* and the second cylinder bore 13*a* accommodates a double-headed piston 25, while permitting the piston 25 to reciprocate in the front-rear direction.

Each double-headed piston 25 is engaged with the periphery of the swash plate 23 with two shoes 26. The shoes 26 convert rotation of the swash plate 23, which rotates with the rotary shaft 21, to linear reciprocation of the double-headed pistons 25. In each first cylinder bore 12*a*, a first compression chamber 20*a* is defined by the double-headed piston 25 and the first valve plate 16. In each second cylinder bore 13*a*, a second compression chamber 20*b* is defined by the double-headed piston 25 and the second valve plate 17.

The first cylinder block 12 has a first large diameter hole 12*b*, which is continuous with the shaft hole 12*h* and has a larger diameter than the shaft hole 12*h*. The first large diameter hole 12*b* communicates with the crank chamber 24. The crank chamber 24 and the suction chamber 14*a* are connected to each other by a suction passage 12*c*, which extends through the first cylinder block 12 and the first valve plate 16.

The second cylinder block 13 has a second large diameter hole 13*b*, which is continuous with the shaft hole 13*h* and has a larger diameter than the shaft hole 13*h*. The second large diameter hole 13*b* communicates with the crank chamber 24. The crank chamber 24 and the suction chamber 15*a* are connected to each other by a suction passage 13*c*, which extends through the second cylinder block 13 and the second valve plate 17.

A suction inlet 13*s* is formed in the peripheral wall of the second cylinder block 13. The suction inlet 13*s* is connected to the external refrigerant circuit. Refrigerant gas is drawn into the crank chamber 24 from the external refrigerant circuit via the suction inlet 13*s* and is then drawn in to the suction chambers 14*a*, 15*a* via the suction passages 12*c*, 13*c*. The suction chambers 14*a*, 15*a* and the crank chamber 24 are therefore in a suction pressure zone. The pressure in the suction chambers 14*a*, 15*a* and the pressure in the crank chamber 24 are substantially equal to each other.

The rotary shaft 21 has an annular flange portion 21*f*, which extends in the radial direction. The flange portion 21*f* is arranged in the first large diameter hole 12*b*.

With respect to the axial direction of the rotary shaft 21, a thrust bearing 27*a* is arranged between the flange portion 21*f* and the first cylinder block 12.

A drive force transmitting member 31 is fixed to the rotary shaft 21 to be rotational integrally with the rotary shaft 21. The drive force transmitting member 31 is located on the rotary shaft 21 and between the flange portion 21*f* and the swash plate 23. The drive force transmitting member 31 includes an annular main body 31*a* and a link portion 31*c*, which projects toward the swash plate 23 from an end face of the main body 31*a* that faces the swash plate 23. The link portion 31*c* guides the swash plate 23 to change the inclination angle. An outer circumferential surface 311*c* of the link portion 31*c* is curved to be arcuate and located on the same circumferential surface as the outer circumferential surface 311*a* of the main body 31*a*. The outer circumferential surface 311*a* of the main body 31*a* and the outer circumferential surface 311*c* of the link portion 31*c* extend along the axis L of the rotary shaft 21. The link portion 31*c* has an insertion hole 31*h* for receiving a columnar first pin 41. The insertion hole 31*h* has an elongated shape that extends linearly such that the insertion hole 31*h* approaches the rotary shaft 21 as the distance from the distal end of the link portion 31*c* decreases.

Further, the swash plate 23 has a coupling portion 23*c* on the upper side (upper side as viewed in FIG. 1). The coupling portion 23*c* protrudes toward the link portion 31*c* of the drive force transmitting member 31. The coupling portion 23*c* has a circular insertion hole 23*d* for receiving the first pin 41. The first pin 41 couples the link portion 31*c* of the drive force transmitting member 31 to the coupling portion 23*c* of the swash plate 23. This allows the drive force of the rotary shaft 21 to be transmitted to the swash plate 23 via the drive force transmitting member 31, so that the swash plate 23 rotates. The first pin 41 is press fitted to the insertion holes 23*d* to be bound to the coupling portion 23*c* of the swash plate 23 and slidably held by the insertion hole 31*h*.

A movable body 32 is located between the flange portion 21*f* and the drive force transmitting member 31. The movable body 32 is movable along the axis L of the rotary shaft 21 with respect to the drive force transmitting member 31. Therefore, the drive force transmitting member 31 and the movable body 32 are accommodated in a space of the first cylinder block 12 and the second cylinder block 13 that is inward in the radial direction of the rotary shaft 21 of the region where the double-headed pistons 25 reciprocate. The drive force transmitting member 31 and the movable body 32 are located on the front side (on one side) of the swash plate 23 in the axial direction of the rotary shaft 21.

The movable body 32 is formed by an annular bottom portion 32*a* and a cylindrical portion 32*b*. An insertion hole 32*e* is formed in the bottom portion 32*a* to receive the rotary shaft 21. The cylindrical portion 32*b* extends along the axis L of the rotary shaft 21 from the peripheral edge of the bottom portion 32*a* and surrounds the rotary shaft 21. The cylindrical portion 32*b* is permitted to move along the axis L of the rotary shaft 21 while an inner circumferential surface 321*b* of the cylindrical portion 32*b* slides along the outer circumferential surface 311*a* of the main body 31*a* of the drive force transmitting member 31 and the outer circumferential surface 311*c* of the link portion 31*c*. Thus, a part of the drive force transmitting member 31 and a part of the movable body 32 in the axial direction of the rotary shaft 21 overlap with each other in the radial direction of the rotary shaft 21. The movable body 32 is caused to rotate integrally with the rotary shaft 21 by the drive force transmitting member 31. The clearance between the inner circumferential surface 321*b* of the cylindrical portion 32*b* and the main body 31*a* of the drive force transmitting member 31 is sealed with a sealing member 33.

The bottom portion 32*a* has a protrusion 32*f* at a position where the rotary shaft 21 is received. The protrusion 32*f* protrudes toward the drive force transmitting member 31 and along the axis L of the rotary shaft 21. An annular holding groove 32*d* is formed in the inner circumferential surface of the protrusion 32*f*. The holding groove 32*d* holds a sealing member 34, which seals the boundary between the insertion hole 32*e* and the rotary shaft 21. The drive force transmitting member 31 has a recess 31*f* at a part that faces the protrusion 32*f*. As the movable body 32 moves, the protrusion 32*f* is received by the recess 31*f*. The drive force transmitting member 31 and the movable body 32 define a control pressure chamber 35.

A first in-shaft passage 21*a* is formed in the rotary shaft 21. The first in-shaft passage 21*a* extends along the axis L of the rotary shaft 21. The rear end of the first in-shaft passage 21*a* is opened to the interior of the pressure adjusting chamber 15*c*. A second in-shaft passage 21*b* is formed in the rotary shaft 21. The second in-shaft passage 21*b* extends in the radial direction of the rotary shaft 21. One end of the second in-shaft passage 21*b* communicates with the first in-shaft passage 21*a*. The other end of the second in-shaft passage 21*b* is opened to the interior of the control pressure chamber 35. Accordingly, the control pressure chamber 35 and the pressure adjusting chamber 15*c* are connected to each other by the first in-shaft passage 21*a* and the second in-shaft passage 21*b*.

Figure 2:
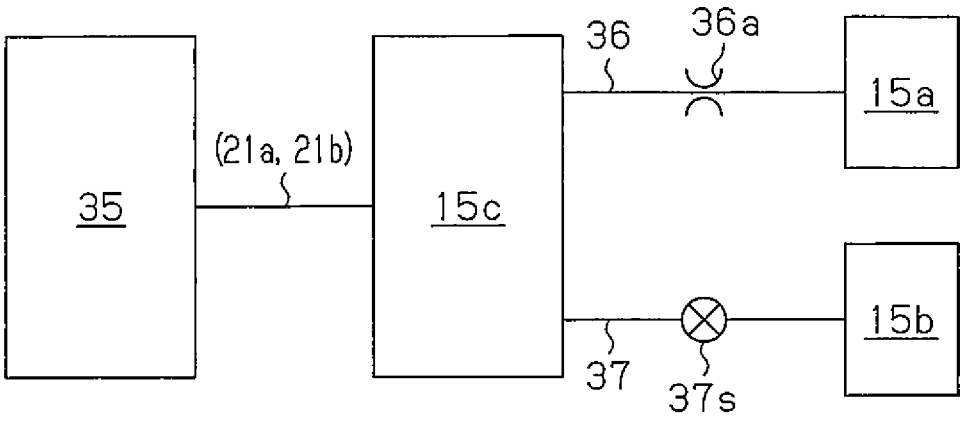
FIG. 2 is a diagram showing the arrangement of a control pressure chamber, a pressure adjusting chamber, a suction chamber, and a discharge chamber.

As shown in FIG. 2, the pressure adjusting chamber 15*c* and the suction chamber 15*a* are connected to each other by the bleed passage 36. The bleed passage 36 has an orifice 36*a*, which restricts the flow rate of refrigerant gas flowing in the bleed passage 36. The pressure adjusting chamber 15*c* and the discharge chamber 15*b* are connected to each other by a supply passage 37. An electromagnetic control valve 37*s* is arranged in the supply passage 37. The control valve 37*s* is capable of adjusting the opening degree of the supply passage 37 based on the pressure in the suction chamber 15*a*. The control valve 37*s* adjusts the flow rate of refrigerant gas flowing in the supply passage 37.

Refrigerant gas is introduced to the control pressure chamber 35 from the discharge chamber 15*b* via the supply passage 37, the pressure adjusting chamber 15*c*, the first in-shaft passage 21*a*, and the second in-shaft passage 21*b*. Refrigerant gas is delivered to the suction chamber 15*a* from the control pressure chamber 35 via the second in-shaft passage 21*b*, the first in-shaft passage 21*a*, the pressure adjusting chamber 15*c*, and the bleed passage 36. The introduction and delivery of refrigerant gas changes the pressure in the control pressure chamber 35. The pressure difference between the control pressure chamber 35 and the crank chamber 24 causes the movable body 32 to move along the axis L of the rotary shaft 21 with respect to the drive force transmitting member 31. Therefore, the refrigerant gas introduced into the control pressure chamber 35 serves as control gas for moving the movable body 32 in the axial direction of the rotary shaft 21.

As shown in FIG. 1, a coupling portion 32*c* is formed at the distal end of the cylindrical portion 32*b* of the movable body 32. The coupling portion 32*c* protrudes toward the swash plate 23. The coupling portion 32*c* has an insertion hole 32*h* for receiving a columnar second pin 42. The insertion hole 32*h* has an elongated shape that extends linearly such that the insertion hole 32*h* approaches the rotary shaft 21 as the distance from the distal end of the coupling portion 32*c* decreases. The swash plate 23 has a circular insertion hole 23*h* for receiving the second pin 42 on the lower side (lower side as viewed in FIG. 1). The second pin 42 couples the coupling portion 32*c* to the lower part of the swash plate 23. The second pin 42 is press fitted to the insertion holes 23*h* to be bound to the swash plate 23 and slidably held by the insertion hole 32*h*.

In the compressor 10 having the above described embodiment, reduction in the opening degree of the control valve 37*s* reduces the amount of refrigerant gas that is delivered to the control pressure chamber 35 from the discharge chamber 15*b* via the supply passage 37, the pressure adjusting chamber 15*c*, the first in-shaft passage 21*a*, and the second in-shaft passage 21*b*. Since the refrigerant gas is delivered to the suction chamber 15*a* from the control pressure chamber 35 via the second in-shaft passage 21*b*, the first in-shaft passage 21*a*, the pressure adjusting chamber 15*c*, and the bleed passage 36, the pressure in the control pressure chamber 35 and the pressure in the suction chamber 15*a* are substantially equalized. This eliminates the pressure difference between the control pressure chamber 35 and the crank chamber 24. Accordingly, the inner circumferential surface 321*b* of the cylindrical portion 32*b* slides along the outer circumferential surface 311*a* of the main body 31*a* of the drive force transmitting member 31 and the outer circumferential surface 311*c* of the link portion 31*c*, so that the bottom portion 32*a* approaches the drive force transmitting member 31 with the movable body 32 being guided along the axis L of the rotary shaft 21.

The second pin 42 slides in the insertion hole 32*h* to approach the rotary shaft 21, and the first pin 41 slides in the insertion hole 31*h* to approach the rotary shaft 21. As a result, the lower part of the swash plate 23 swings away from the drive force transmitting member 31, while the upper part of the swash plate 23 swings toward the drive force transmitting member 31. This reduces the inclination angle of the swash plate 23 and thus reduces the stroke of the double-headed pistons 25. Accordingly, the displacement is decreased.

Figure 3:
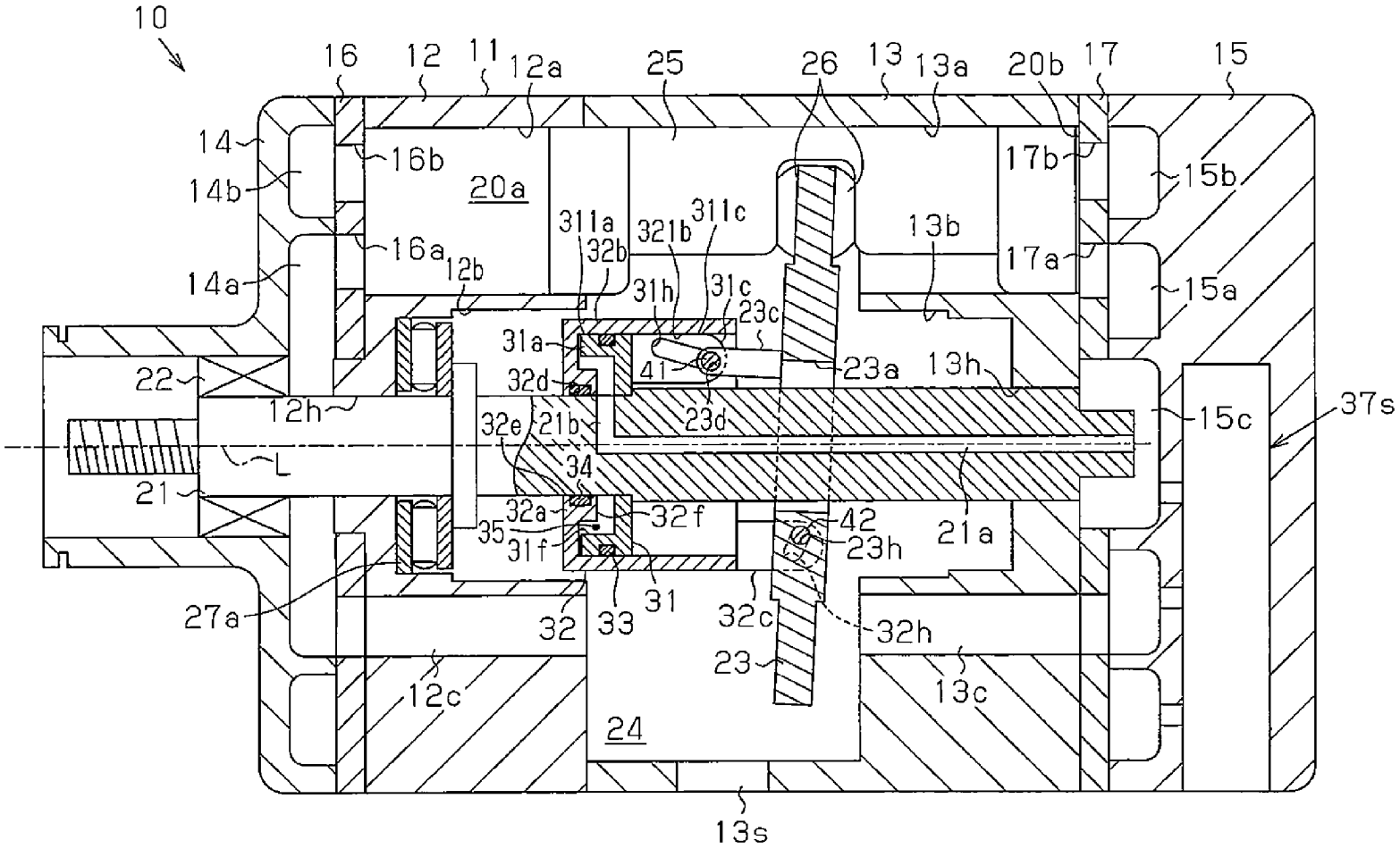
FIG. 3 is a cross-sectional side view illustrating the double-headed piston swash plate type compressor when the inclination angle of the swash plate is minimized.

When the inclination angle of the swash plate 23 is minimized as shown in FIG. 3, the second pin 42 slides to a position in the insertion hole 32*h* that is closest to the rotary shaft 21. Likewise, the first pin 41 slides to a position in the insertion hole 31*h* that is closest to the rotary shaft 21. When the inclination angle of the swash plate 23 reaches the minimum inclination angle, the cylindrical portion 32*b* of the movable body 32 surrounds the entire drive force transmitting member 31. That is, when the inclination angle of the swash plate 23 reaches the minimum inclination angle, the cylindrical portion 32*b* of the movable body 32 accommodates the entire drive force transmitting member 31. Further, the protrusion 32*f* enters the recess 31*f* as the movable body 32 moves toward the swash plate 23.

In contrast, increase in the opening degree of the control valve 37*s* increases the amount of refrigerant gas that is delivered to the control pressure chamber 35 from the discharge chamber 15*b* via the supply passage 37, the pressure adjusting chamber 15*c*, the first in-shaft passage 21*a*, and the second in-shaft passage 21*b*. This substantially equalizes the pressure in the control pressure chamber 35 to the pressure in the discharge chamber 15*b*. Thus, the pressure difference between the control pressure chamber 35 and the crank chamber 24 is increased. The inner circumferential surface 321*b* of the cylindrical portion 32*b* slides along the outer circumferential surface 311*a* of the main body 31*a* of the drive force transmitting member 31 and the outer circumferential surface 311*c* of the link portion 31*c*. Accordingly, the movable body 32 is moved while being guided along the axis L of the rotary shaft 21 such that the bottom portion 32*a* is separated away from the drive force transmitting member 31.

The second pin 42 slides in the insertion hole 32*h* to move away from the rotary shaft 21. Likewise, the first pin 41 slides in the insertion hole 31*h* to move away from the rotary shaft 21. As a result, the lower part of the swash plate 23 swings to approach the drive force transmitting member 31. In contrast, the upper part of the swash plate 23 swings to move away from the drive force transmitting member 31. This increases the inclination angle of the swash plate 23 and thus increases the stroke of the double-headed pistons 25. Accordingly, the displacement is increased.

When the inclination angle of the swash plate 23 is maximized as shown in FIG. 1, the second pin 42 slides to a position in the insertion hole 32*h* that is farthest from the rotary shaft 21. Likewise, the first pin 41 slides to a position in the insertion hole 31*h* that is farthest from the rotary shaft 21. In this manner, the cylindrical portion 32*b* is permitted to move in the axial direction of the rotary shaft 21 while sliding along the outer circumferential surface 311*a* of the main body 31*a* of the drive force transmitting member 31 and the outer circumferential surface 311*c* of the link portion 31*c*, so that the inclination angle of the swash plate 23 is changed in accordance with changes in the pressure in the control pressure chamber 35.

Operation of the present embodiment will now be described.

The drive force transmitting member 31 and the movable body 32 are located on the front side of the swash plate 23 in the axial direction of the rotary shaft 21. The drive force transmitting member 31 and the movable body 32 define the control pressure chamber 35. That is, the control pressure chamber 35 is defined by utilizing the drive force transmitting member 31, which is an existing structure. Further, the control pressure chamber 35 is arranged on the front side of the swash plate 23 in the axial direction of the rotary shaft 21. Moreover, a part of the drive force transmitting member 31 and a part of the movable body 32 in the axial direction of the rotary shaft 21 overlap with each other in the radial direction of the rotary shaft 21.

The drive force transmitting member 31 and the movable body 32 are accommodated in a space of the first cylinder block 12 and the second cylinder block 13 that is inward in the radial direction of the rotary shaft 21 of the region where the double-headed pistons 25 reciprocate. According to the above described configuration, the size of the space for accommodating the drive force transmitting member 31 and the movable body 32 is minimized in the axial direction of the rotary shaft 21.

The compressor described above in the Background of the Invention section includes the drive force transmitting member located on the front side of the swash plate in the axial direction of the rotary shaft, and the movable body and the control pressure chamber are arranged on the rear side of the swash plate in the axial direction of the rotary shaft. Compared to the conventional compressor having such a configuration, the compressor 10 of the present embodiment, which has the above described configuration, has a reduced size in the axial direction of the rotary shaft 21.

Figure 4:
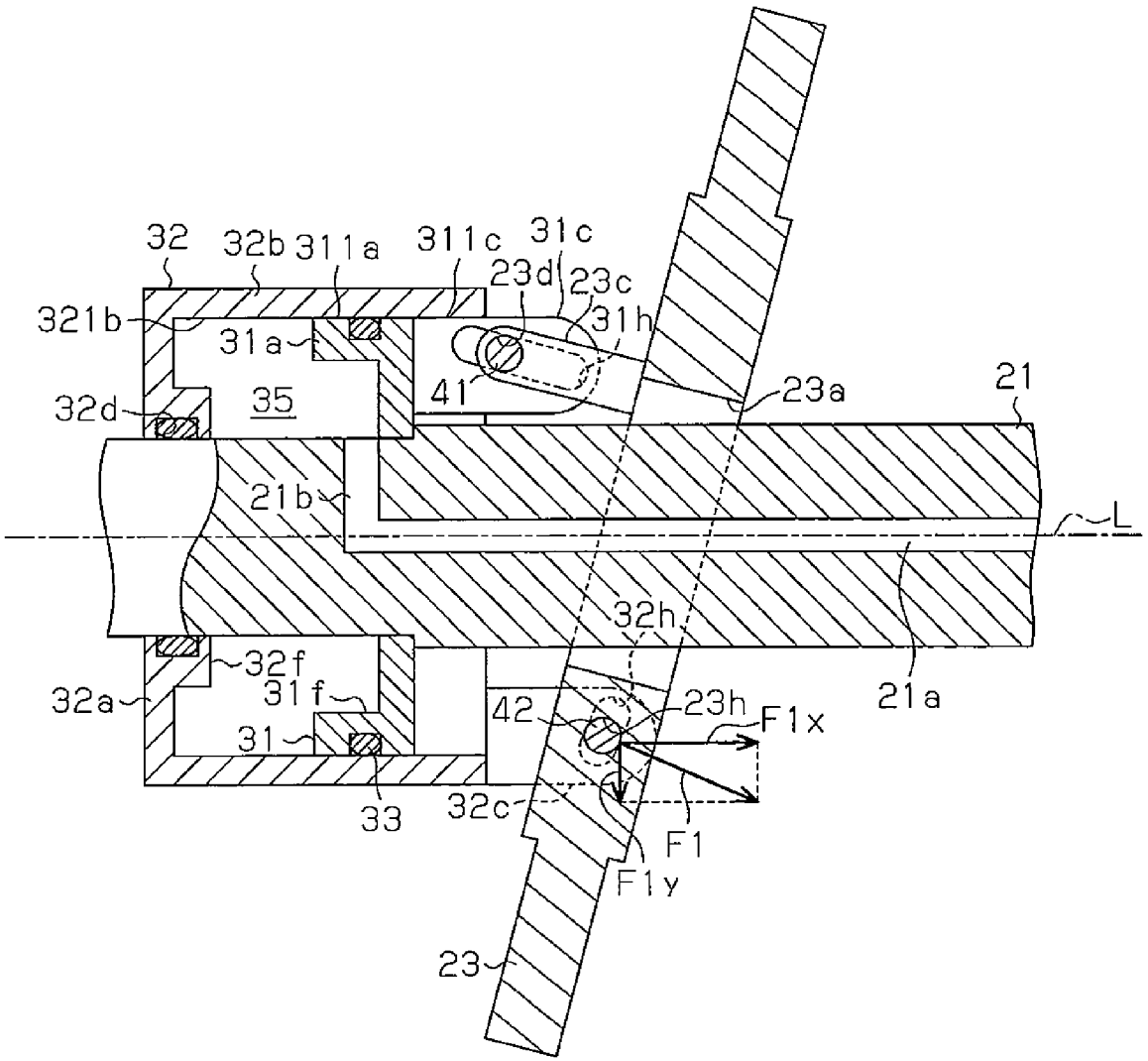
FIG. 4 is a cross-sectional side view partially showing the double-headed piston swash plate type compressor when the swash plate is at a predetermined inclination angle.

For example, the swash plate 23 of the compressor 10 is at a certain inclination angle in FIG. 4. The inclination angle in FIG. 4 is greater than the minimum inclination angle and smaller than the maximum inclination angle. When the inclination angle of the swash plate 23 is changed from the certain inclination angle, the movable body 32 is moved away from the swash plate 23 due to the pressure difference between the control pressure chamber 35 and the crank chamber 24.

At the contacting point between the second pin 42 and the coupling portion 32*c*, a force F1 along the normal line acts on the coupling portion 32*c*. The direction of the force F1 is a direction away from the movable body 32 and intersects the moving direction of the movable body 32 (the axial direction of the rotary shaft 21). The force F1 is resolved into a force F1y, which has a component in a direction perpendicular to the moving direction of the movable body 32 (the vertical direction), and a force F1x, which has a component in the moving direction of the movable body 32 (the horizontal direction). The force F1y, which has a component in a direction perpendicular to the moving direction of the movable body 32, acts on the coupling portion 32*c* in a direction away from the rotary shaft 21. Therefore, the force F1y, which has a component in a direction perpendicular to the moving direction of the movable body 32, acts to tilt the movable body 32 relative to the moving direction of the movable body 32 via the coupling portion 32*c*.

According to the preset embodiment, the outer circumferential surface 311*a* of the main body 31*a* and the outer circumferential surface 311*c* of the link portion 31*c* extend along the axis L of the rotary shaft 21. That is, the outer circumferential surface 311*a* of the main body 31*a* and the outer circumferential surface 311*c* of the link portion 31*c* extend parallel with the axis L of the rotary shaft 21. Accordingly, the inner circumferential surface 321*b* of the cylindrical portion 32*b* contacts the outer circumferential surface 311*c* of the link portion 31*c* in addition to the outer circumferential surface 311*a* of the main body 31*a* of the drive force transmitting member 31.

Therefore, compared to a case in which the inner circumferential surface 321*b* of the cylindrical portion 32*b* contacts only the outer circumferential surface 311*a* of the main body 31*a*, the area of contact between the cylindrical portion 32*b* and the drive force transmitting member 31 is increased. Thus, when the inclination angle of the swash plate 23 is changed, the movable body 32 is prevented from being tilted relative to the moving direction even if the force F1y, which acts to tilt the movable body 32 relative to the moving direction, acts on the movable body 32. As a result, the inclination angle of the swash plate 23 is changed smoothly.

The above described embodiment provides the following advantages.

(1) The drive force transmitting member 31 and the movable body 32 are located on the front side of the swash plate 23 in the axial direction of the rotary shaft 21. The drive force transmitting member 31 and the movable body 32 define a control pressure chamber 35. According to this configuration, the control pressure chamber 35 is defined by utilizing the drive force transmitting member 31, which is an existing structure, and the control pressure chamber 35 is located on the front side of the swash plate 23 in the axial direction of the rotary shaft 21.

Further, the cylindrical portion 32*b* is permitted to move in the axial direction of the rotary shaft 21 while sliding along the outer circumferential surface 311*a* of the main body 31*a* and the outer circumferential surface 311*c* of the link portion 31*c*, so that the inclination angle of the swash plate 23 is changed in accordance with changes in the pressure in the control pressure chamber 35. That is, a part of the drive force transmitting member 31 and a part of the movable body 32 in the axial direction of the rotary shaft 21 overlap with each other in the radial direction of the rotary shaft 21. The drive force transmitting member 31 and the movable body 32 are accommodated in a space of the first cylinder block 12 and the second cylinder block 13 that is inward in the radial direction of the rotary shaft 21 of the region where the double-headed pistons 25 reciprocate. According to the above described configuration, it is possible to minimize the size of the space for accommodating the drive force transmitting member 31 and the movable body 32 in the axial direction of the rotary shaft 21.

The compressor described above in the Background of the Invention section includes the drive force transmitting member located on the front side of the swash plate in the axial direction of the rotary shaft, and the movable body and the control pressure chamber are arranged on the rear side of the swash plate in the axial direction of the rotary shaft. Compared to the conventional compressor having such a configuration, the compressor 10 of the present embodiment, which has the above described configuration, has a reduced size in the axial direction of the rotary shaft 21.

(2) The drive force transmitting member 31 is surrounded by the cylindrical portion 32*b*. This configuration suppresses the temperature increase in the crank chamber 24 caused when lubricant that flows together with refrigerant gas in the crank chamber 24 is agitated by the drive force transmitting member 31, which rotates integrally with the rotary shaft 21.

(3) The bottom portion 32*a* has a protrusion 32*f* at a position where the rotary shaft 21 is received. The protrusion 32*f* protrudes toward the drive force transmitting member 31 and along the axis L of the rotary shaft 21. Further, the holding groove 32*d* is formed in the inner circumferential surface of the protrusion 32*f* to hold the sealing member 34, which seals the boundary between the insertion hole 32*e* and the rotary shaft 21. The drive force transmitting member 31 has a recess 31*f* at a part that faces the protrusion 32*f*. As the movable body 32 moves, the protrusion 32*f* is received by the recess 31*f*.

This configuration reduces the size of the movable body 32 in the axial direction of the rotary shaft 21 compared to a case in which, to form the holding groove 32*d* for holding the sealing member 34, a protrusion that protrudes from a part of the bottom portion 32*a* that receives the rotary shaft 21 and in the axial direction of the rotary shaft 21 is formed in the opposite direction from the drive force transmitting member 31.

Further, compared to a case in which the recess 31*f* is not formed in a part of the drive force transmitting member 31 that faces the protrusion 32*f*, the distance between the movable body 32 and the drive force transmitting member 31 is reduced by the amount by which the protrusion 32*f* enters the recess 31*f* as the movable body 32 moves. As a result, the size of the compressor 10 is further reduced in the axial direction of the rotary shaft 21.

(4) The outer circumferential surface 311*a* of the main body 31*a* and the outer circumferential surface 311*c* of the link portion 31*c* extend along the axis L of the rotary shaft 21. This configuration maximizes the contacting area between the drive force transmitting member 31 and the cylindrical portion 32*b*. Thus, when the inclination angle of the swash plate 23 is changed, the movable body 32 is prevented from being tilted relative to the moving direction even if the force F1y, which acts to tilt the movable body 32 relative to the moving direction, acts on the movable body 32. Therefore, the inclination angle of the swash plate 23 is changed smoothly.

(5) The control pressure chamber 35 is defined by utilizing the drive force transmitting member 31, which is an existing structure. According to this configuration, a member that defines the control pressure chamber 35 together with the movable body 32 does not need to be accommodated in a space of the first cylinder block 12 and the second cylinder block 13 that is inward in the radial direction of the rotary shaft 21 of the region where the double-headed pistons 25 reciprocate.

This minimizes the number of components accommodated in a space of the first cylinder block 12 and the second cylinder block 13 that is inward in the radial direction of the rotary shaft 21 of the region where the double-headed pistons 25 reciprocate. This prevents, inside the first cylinder block 12 and the second cylinder block 13, the size of the compressor 10 from being increased in the axial direction of the rotary shaft 21 by the space for accommodating an additional member when the number of components is increased in the space that is inward in the radial direction of the rotary shaft 21 of the region in which the double-headed pistons 25 reciprocate.

The above described embodiment may be modified as follows.

Figure 5:
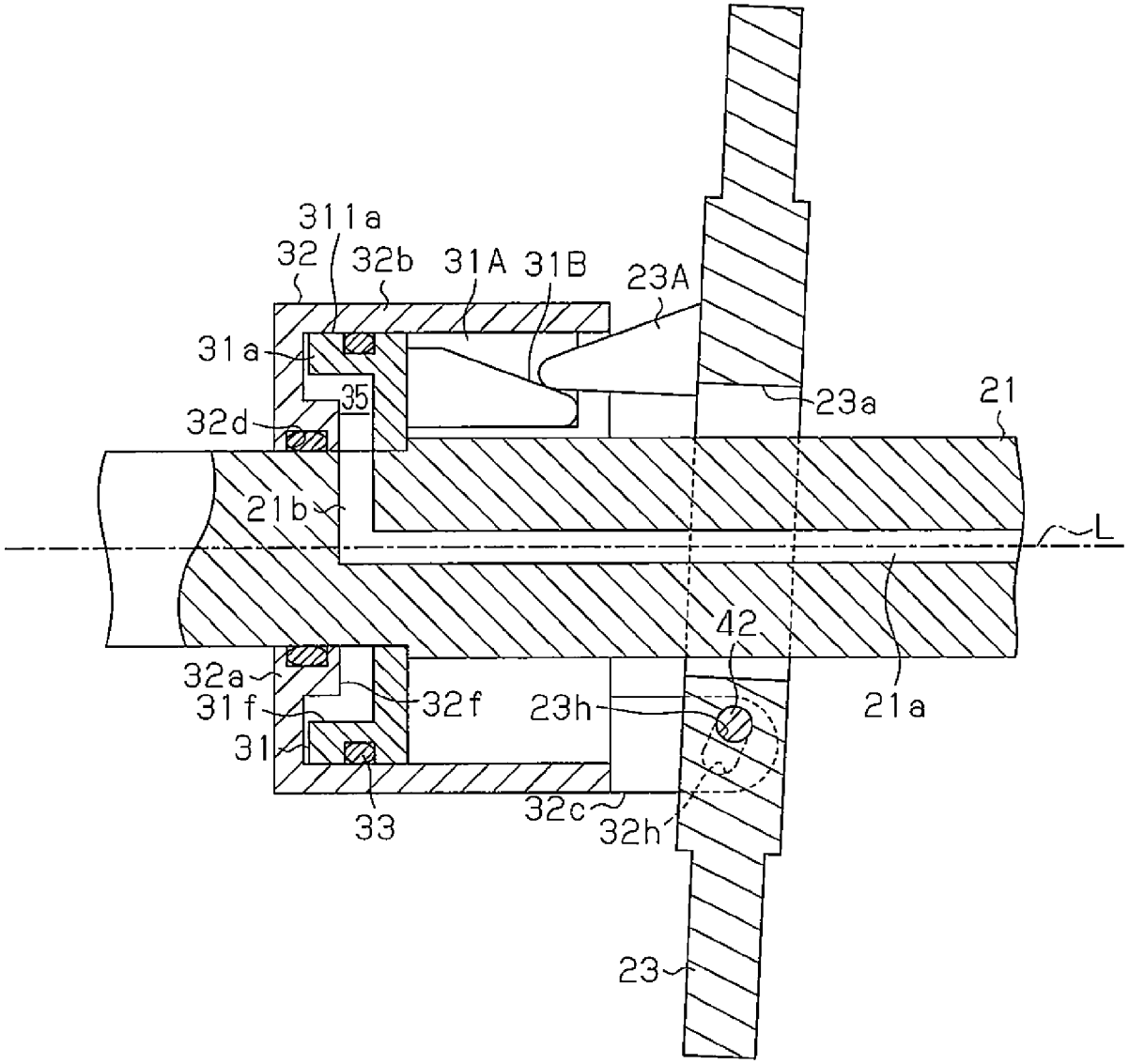
FIG. 5 is a cross-sectional side view illustrating a double-headed piston swash plate type compressor according to another embodiment when the inclination angle of the swash plate is maximized.
Figure 6:
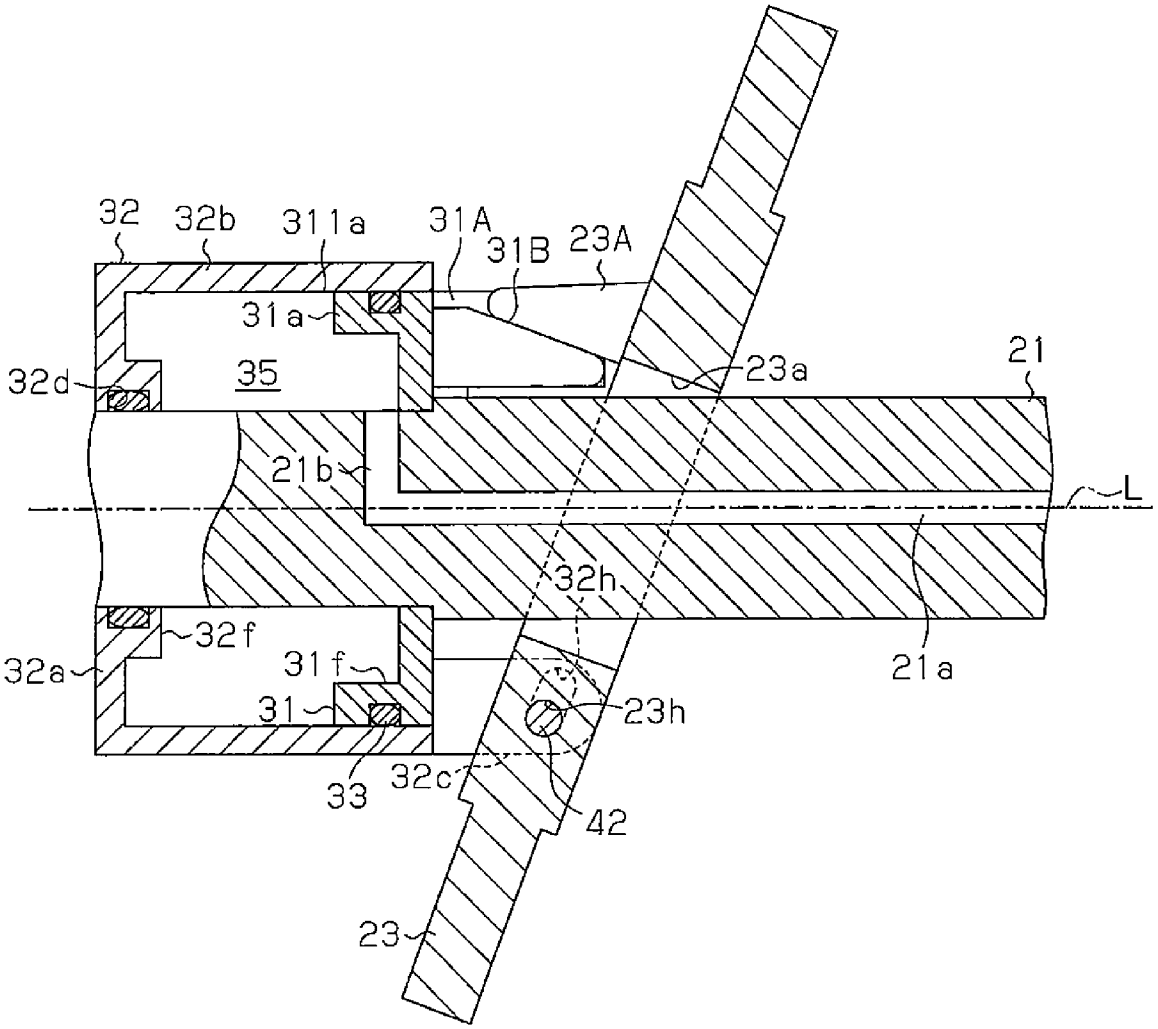
FIG. 6 is a cross-sectional side view illustrating the double-headed piston swash plate type compressor when the inclination angle of the swash plate is minimized.
Figure 7:
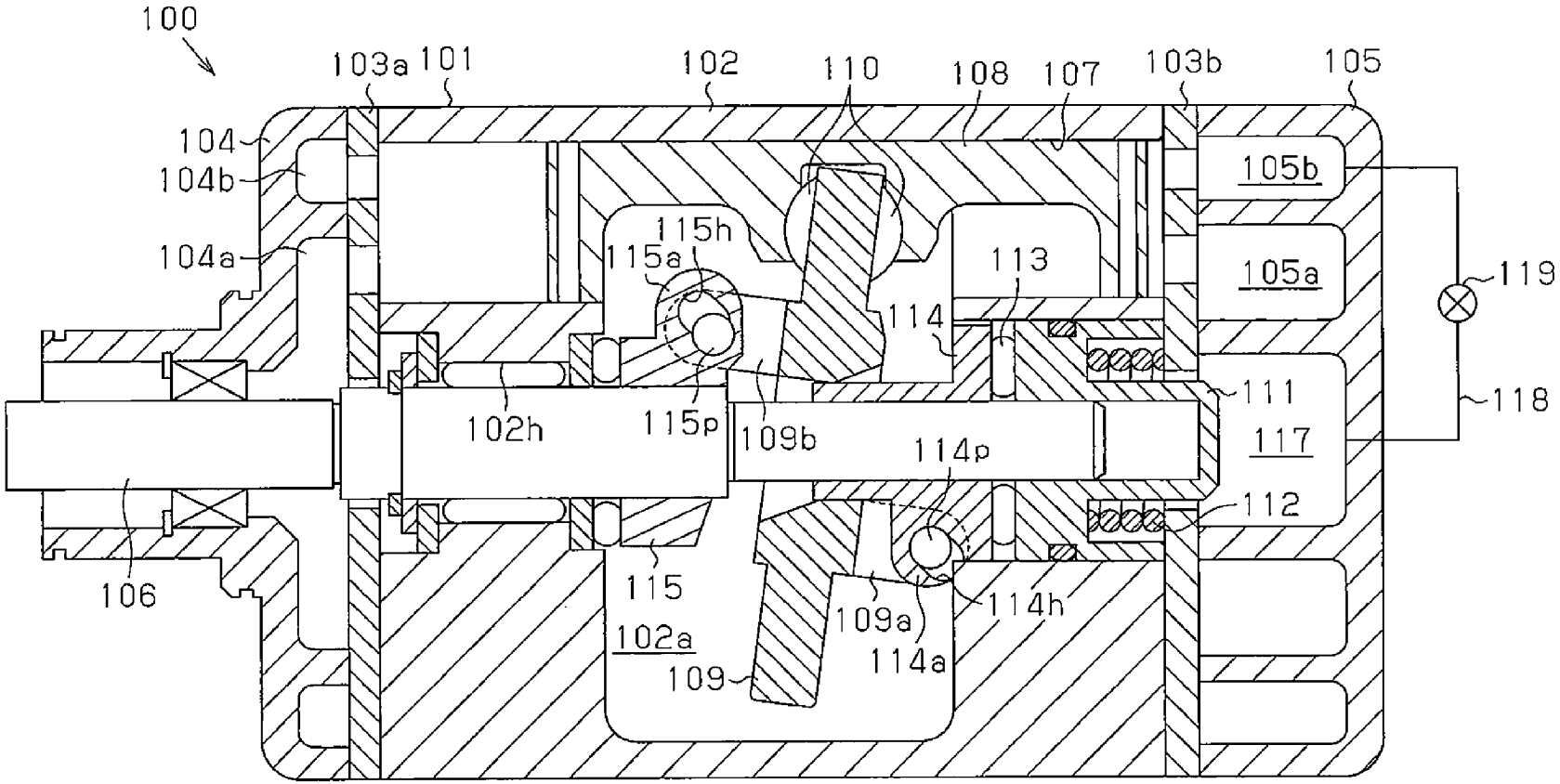
Fig.7 (PRIOR ART)
FIG. 7 is a cross-sectional side view illustrating a conventional variable displacement swash plate type compressor.
Figure 8:
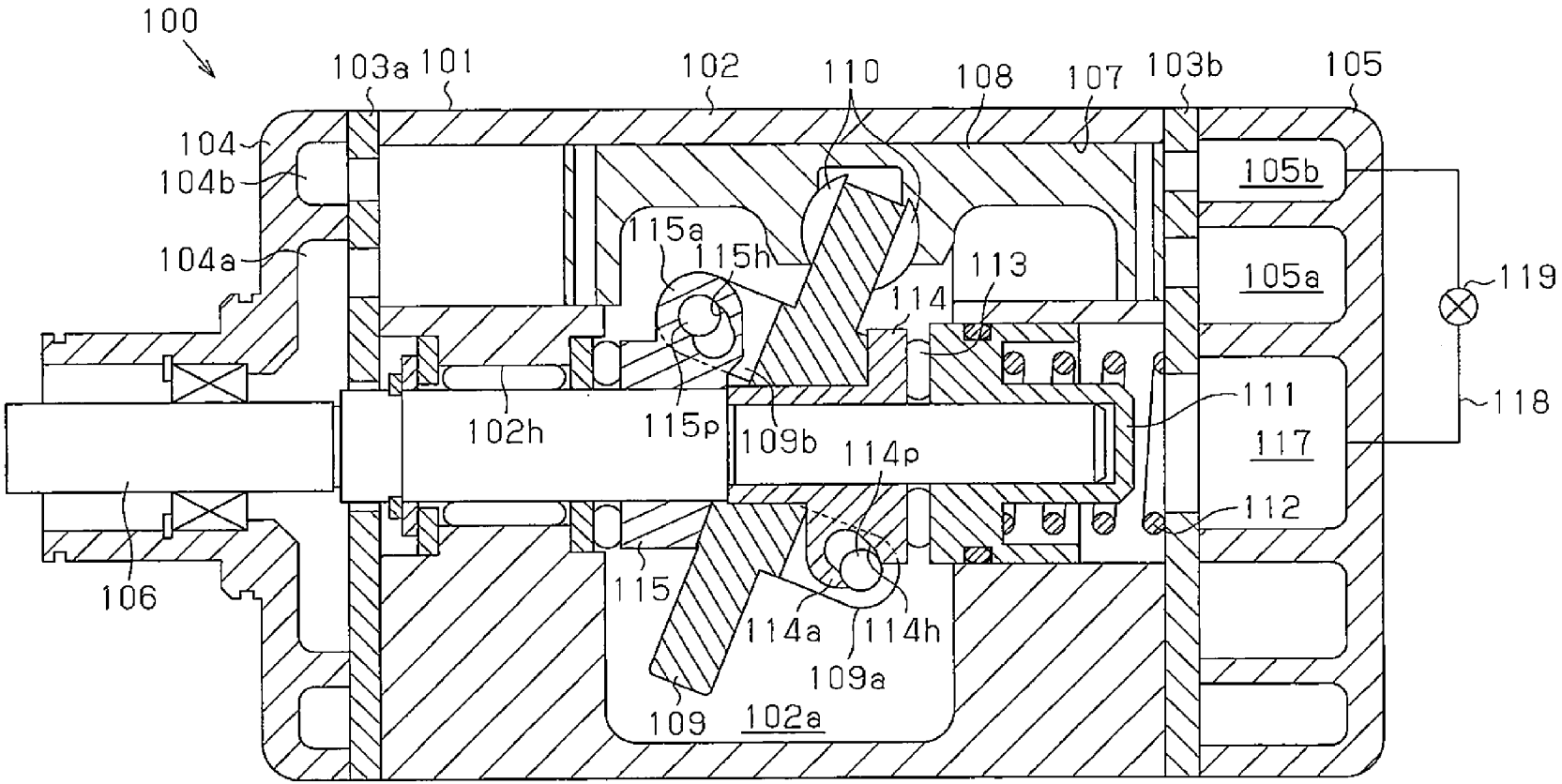
Fig.8 (PRIOR ART)
FIG. 8 is a cross-sectional side view illustrating the conventional variable displacement swash plate type compressor when the inclination angle of the swash plate is maximized.

As illustrated in FIGS. 5 and 6, the drive force transmitting member 31 may include two arms 31A, which serve as a link portion and extend toward the swash plate 23, and the swash plate 23 may have a protrusion 23A extending toward the drive force transmitting member 31. The protrusion 23A is inserted between the two arms 31A and is movable along the space between the arms 31A while being held between the arms 31A.

A cam surface 31B is formed at the bottom between the arms 31A. The protrusion 23A is slidable along the cam surface 31B. The swash plate 23 is permitted to tilt in the axial direction of the rotary shaft 21 by cooperation of the protrusion 23A between the arms 31A and the cam surface 31B. The drive force of the rotary shaft 21 is transmitted to the protrusion 23A via the two arms 31A so that the swash plate 23 rotates. When the swash plate 23 is tilted toward the axis L of the rotary shaft 21, the protrusion 23A slides along the cam surface 31B.

In the illustrated embodiment, the outer circumferential surface 311*c* of the link portion 31*c* does not necessarily need to be located on the same circumferential surface as the outer circumferential surface 311*a* of the main body 31*a*. For example, the outer circumferential surface 311*c* of the link portion 31*c* may be located inward of the outer circumferential surface 311*a* of the main body 31*a* in the radial direction of the rotary shaft 21. In this case, the cylindrical portion 32*b* is permitted to move in the axial direction of the rotary shaft 21 while sliding along the outer circumferential surface 311*a* of the main body 31*a*, so that the inclination angle of the swash plate 23 is changed in accordance with changes in the pressure in the control pressure chamber 35.

In the illustrated embodiment, to form the holding groove 32*d* for holding the sealing member 34, a protrusion that protrudes in a direction opposite from the drive force transmitting member 31 may be formed at a part of the bottom portion 32*a* that receives the rotary shaft 21.

In the illustrated embodiment, the cylindrical portion 32*b* does not necessarily need to surround the entire drive force transmitting member 31 when the inclination angle of the swash plate 23 reaches the minimum inclination angle.

In the illustrated embodiment, the insertion hole 31*h* may have, for example, an elongated shape that extends linearly in a direction perpendicular to the axial direction of the rotary shaft 21.

In the illustrated embodiment, the insertion hole 32*h* may have, for example, an elongated shape that extends linearly in a direction perpendicular to the axial direction of the rotary shaft 21.

In the illustrated embodiment, the insertion hole 31*h* may have a circular shape, and the insertion hole 23*d* may have an elongated shape. Further, the first pin 41 may be press fitted to the insertion holes 31*h* to be bound to the link portion 31*c* of the drive force transmitting member 31, and slidably held by the insertion hole 23*d*.

In the illustrated embodiment, the insertion hole 32*h* may have a circular shape, and the insertion hole 23*h* may have an elongated shape. Further, the second pin 42 may be press fitted to the insertion holes 32*h* to be bound to the coupling portion 32*c* of the movable body 32, and slidably held by the insertion hole 23*h*.

Therefore, the present examples and embodiments are to be considered as illustrative and not restrictive and the invention is not to be limited to the details given herein, but may be modified within the scope and equivalence of the appended claims.

The invention claimed is:

1. A double-headed piston swash plate type compressor comprising:

a pair of cylinder blocks, which forms a housing and has a crank chamber;

a first cylinder bore and a second cylinder bore, which are respectively formed in the two cylinder blocks to form a pair;

a double-headed piston reciprocally received in the first and second cylinder bores;

a rotary shaft, which is rotationally supported by the housing;

a drive force transmitting member, which is accommodated in the crank chamber and fixed to the rotary shaft to rotate integrally with the rotary shaft;

a swash plate, which is accommodated in the crank chamber and rotated by a drive force of the rotary shaft via the drive force transmitting member, wherein an inclination angle of the swash plate relative to the rotary shaft is changeable, the drive force transmitting member has a link portion that guides the swash plate to change the inclination angle, and the double-headed piston is engaged with the swash plate and is reciprocated by a stroke that corresponds to the inclination angle of the swash plate;

a movable body, which is coupled to the swash plate and capable of changing the inclination angle of the swash plate; and a control pressure chamber, which is defined by the movable body and the drive force transmitting member, wherein the drive force transmitting member and the movable body are arranged on one side of the swash plate in an axial direction of the rotary shaft, control gas is introduced into the control pressure chamber to change an internal pressure of the control pressure chamber, so that the movable body is moved in the axial direction of the rotary shaft, the movable body includes a bottom portion, through which the rotary shaft extends, and a cylindrical portion, which extends from the bottom portion in the axial direction of the rotary shaft to surround the rotary shaft, and the cylindrical portion is permitted to move in the axial direction of the rotary shaft while in contact with an outer circumferential surface of the drive force transmitting member, so that the inclination angle of the swash plate is changed in accordance with changes in the internal pressure of the control pressure chamber.

2. The double-headed piston swash plate type compressor according to claim 1, wherein the cylindrical portion of the movable body is in contact with the outer circumferential surface of the drive force transmitting member in a case where the inclination angle of the swash plate is maximized and in a case where the inclination angle of the swash plate is minimized.

3. A double-headed piston swash plate type compressor comprising:

a pair of cylinder blocks, which forms a housing and has a crank chamber;

a first cylinder bore and a second cylinder bore, which are respectively formed in the two cylinder blocks to form a pair;

a double-headed piston reciprocally received in the first and second cylinder bores;

a rotary shaft, which is rotationally supported by the housing;

a drive force transmitting member, which is accommodated in the crank chamber and fixed to the rotary shaft to rotate integrally with the rotary shaft;

a swash plate, which is accommodated in the crank chamber and rotated by a drive force of the rotary shaft via the drive force transmitting member, wherein an inclination angle of the swash plate relative to the rotary shaft is changeable, the drive force transmitting member has a link portion that guides the swash plate to change the inclination angle, and the double-headed piston is engaged with the swash plate and is reciprocated by a stroke that corresponds to the inclination angle of the swash plate;

a movable body, which is coupled to the swash plate and capable of changing the inclination angle of the swash plate; and a control pressure chamber, which is defined by the movable body and the drive force transmitting member, wherein the drive force transmitting member and the movable body are arranged on one side of the swash plate in an axial direction of the rotary shaft, control gas is introduced into the control pressure chamber to change an internal pressure of the control pressure chamber, so that the movable body is moved in the axial direction of the rotary shaft, the movable body includes a bottom portion, through which the rotary shaft extends, and a cylindrical portion, which extends from the bottom portion in the axial direction of the rotary shaft to surround the rotary shaft, and the cylindrical portion is permitted to move in the axial direction of the rotary shaft while sliding along a radially outermost circumferential surface of the drive force transmitting member, so that the inclination angle of the swash plate is changed in accordance with changes in the internal pressure of the control pressure chamber.

4. The double-headed piston swash plate type compressor according to claim 3, wherein the cylindrical portion of the movable body is in contact with the outer circumferential surface of the drive force transmitting member in a case where the inclination angle of the swash plate is maximized and in a case where the inclination angle of the swash plate is minimized.

5. A double-headed piston swash plate type compressor comprising:

a pair of cylinder blocks, which forms a housing and has a crank chamber;

a first cylinder bore and a second cylinder bore, which are respectively formed in the two cylinder blocks to form a pair;

a double-headed piston reciprocally received in the first and second cylinder bores;

a rotary shaft, which is rotationally supported by the housing;

a drive force transmitting member, which is accommodated in the crank chamber and fixed to the rotary shaft to rotate integrally with the rotary shaft;

a swash plate, which is accommodated in the crank chamber and rotated by a drive force of the rotary shaft via the drive force transmitting member, wherein an inclination angle of the swash plate relative to the rotary shaft is changeable, the drive force transmitting member has a link portion that guides the swash plate to change the inclination angle, and the double-headed piston is engaged with the swash plate and is reciprocated by a stroke that corresponds to the inclination angle of the swash plate;

a movable body, which is coupled to the swash plate and capable of changing the inclination angle of the swash plate; and a control pressure chamber, which is defined by the movable body and the drive force transmitting member, wherein the drive force transmitting member and the movable body are arranged on one side of the swash plate in an axial direction of the rotary shaft, control gas is introduced into the control pressure chamber to change an internal pressure of the control pressure chamber, so that the movable body is moved in the axial direction of the rotary shaft, the movable body includes a bottom portion, through which the rotary shaft extends, and a cylindrical portion, which extends from the bottom portion in the axial direction of the rotary shaft to surround the rotary shaft, and the cylindrical portion is permitted to move in the axial direction of the rotary shaft while sliding along an outer circumferential surface of the drive force transmitting member, so that the inclination angle of the swash plate is changed in accordance with changes in the internal pressure of the control pressure chamber, wherein the cylindrical portion of the movable body is in contact with the outer circumferential surface of the drive force transmitting member in a case where the inclination angle of the swash plate is maximized and in a case where the inclination angle of the swash plate is minimized.

6. The double-headed piston swash plate type compressor according to claim 5, wherein the cylindrical portion surrounds the entire drive force transmitting member.

7. The double-headed piston swash plate type compressor according to claim 5, wherein the bottom portion has a protrusion at a part through which the rotary shaft extends, wherein the protrusion protrudes toward the drive force transmitting member and in the axial direction of the rotary shaft, a sealing member is provided between the bottom portion and the rotary shaft to seal the boundary between the bottom portion and the rotary shaft, a holding groove is formed in an inner circumferential surface of the protrusion, and the holding groove holds the sealing member for sealing the boundary between the bottom portion and the rotary shaft, and a recess is formed in a part of the drive force transmitting member that faces the protrusion, wherein the protrusion enters the recess as the movable body moves.

8. The double-headed piston swash plate type compressor according to claim 5, wherein the outer circumferential surface of the drive force transmitting member along which the cylindrical portion slides is an outer circumferential surface of the link portion, and the outer circumferential surface of the link portion extends in the axial direction of the rotary shaft.

* * * * *